United States Patent [19]

Min

[11] 4,150,481

[45] Apr. 24, 1979

[54] FINGER-TOE NAIL CLIPPER HAVING SHIFTING RECEPTACLE

[76] Inventor: Manki Min, 45-22, 39th Pl., Sunnyside, Long Island City, N.Y. 11104

[21] Appl. No.: 858,022

[22] Filed: Dec. 6, 1977

Related U.S. Application Data

[63] Continuation-in-part of Ser. No. 680,377, Apr. 26, 1976, Pat. No. 4,062,109.

[51] Int. Cl.[2] ..... A45D 29/02

[52] U.S. Cl. ..... 30/28; 132/73

[58] Field of Search ..... 30/28, 124; 132/73

[56] References Cited

U.S. PATENT DOCUMENTS

| | | | |
|---|---|---|---|
| 2,995,820 | 8/1961 | Pocoski | 30/28 |
| 3,188,737 | 6/1965 | Chase | 30/28 X |
| 3,943,948 | 3/1976 | Sartore | 30/28 |
| 3,997,966 | 12/1976 | Sartore | 30/28 |

*Primary Examiner*—Jimmy C. Peters

[57] ABSTRACT

An improved finger-toe nail clipper including the combination of a conventional finger or toe nail clipper and a compactly designed receptacle shiftingly receivable between the opposing insides of the forward nail clipping ends of the arms of the clipper and opening forwardly toward the opposing nail cutting edges of the clipper arms for catching and retaining the clipped-off finger or toe nail portions as desired.

10 Claims, 19 Drawing Figures

FINGER-TOE NAIL CLIPPER HAVING SHIFTING RECEPTACLE

This application is a continuation-in-part of Ser. No. 680,377, filed Apr. 26, 1976, now U.S. Pat. No. 4,062,109 dated Dec. 13, 1977.

BACKGROUND OF THE INVENTION

The modified conventional finger or toe nail clipper is provided with a pair of generally parallel hardened resilient steel strip members having front and rear ends and the front ends include laterally curved or straight inturned mating cutting edges in spaced-apart, face-to-face relationship while the rear ends of the strip members are secured together to permit the front ends and said cutting edges to be moved toward and away from each other.

Between the front ends of said strip members is defined a space to mount the receptacle for catching, holding and discharging the clipped-off finger or toe nail portions.

A round support post is disposed through the aligned apertures formed through in the forward portions of the strips near the cutting edges of the strip members and the post is provided with a round head at lower end and means for hinging an operating lever near the upper end, the operating lever being provided to apply a force to effect movement of the front ends, and thus the inturned mating offset cutting edges together.

The present invention is an another improved finger or toe nail clipper designed more compactly than my patent pending invention, Finger-toe nail clipper for catching and holding the clipped-off finger or toe nail portions of U.S. Ser. No. 680,377 now U.S. Pat. No. 4,062,109.

Numerous clippers for the same purpose have been previously patented and some have included a structure for catching and releasably retaining clipped-off nail portions. However, few of these latter forms have been widely utilized because of inability to perform as desired, high cost of manufacture, adverse appearance, etc.

BRIEF DESCRIPTION OF THE INVENTION

The present invention relates to an improved finger-toe nail clipper and more particularly to a combination of various types of modified conventional finger or toe nail clippers and the provision of a receptacle to catch and hold the cut-off finger or toe nail portions and removable for emptying the receptacle.

This invention is also well designed for more satisfaction in the points of above-mentioned reasonable needs of utilizability.

In order to eliminate troublesome problems deriving from the using of previous conventional finger or toe nail clippers, the present invention is also designed for simple and more compact construction to be efficient and durable and comprises a practical device for catching, holding and sanitary discharging the severed finger or toe nail portions wherever it is used.

This invention is also provided with an adapting receptacle or a housing member to be accommodated in the space between the front ends of the hardened resilient steel strips for catching and holding portions of the clipped-off finger or toe nail.

The principal object of the invention is to provide an improved finger-toe nail clipper including structure for catching and holding severed finger or toe nail portions until the clipped nail storage portion may be emptied in a desired receptacle, such as trash bags, garbage cans, or the like.

A further object of the invention is also to provide a convenient handling means for the severed nail receptacle of the invention.

A further object of the invention is to provide means for sanitary discharging the accumulated severed nail portions by merely shifting the receptacle from its catching and holding position to its discharging position.

A further object is to provide a way of enjoying the cutting manner of the conventional finger or toe nail clippers by just keeping the receptacle staying in the discharging engagement position.

Another object of this invention is to provide a simple room consisted of wall means to catch and hold the severed nail pieces.

Another object of this invention is to provide guide members thereof by merely enlarging downwardly a pair of opposing longitudinal side walls of the receptacle to be overlapped the opposite longitudinal sides of said strip members to prevent it from seperating in the mounted location, permitting slidable movement back and forth with the outside surfaces of said longitudinal side walls provided with knurled surfaces for non-slip operation.

Another object is to provide a receptacle adaptable to the varying intermediate space between a pair of said strip members when said cutting edges are in cutting motions.

Another object in alternate embodiments of the invention is to provide a more simple selective engaging means without turning the operating lever.

Still another object of this invention is to provide means to avoid the permanent deforming or breaking of the receptacle by means of slit opening.

The various functions of aforesaid objects of this invention have been designed into only a simple embodiment, a plain and compact receptacle; this is the most important distinction in this invention.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE INVENTION

Figure 2:
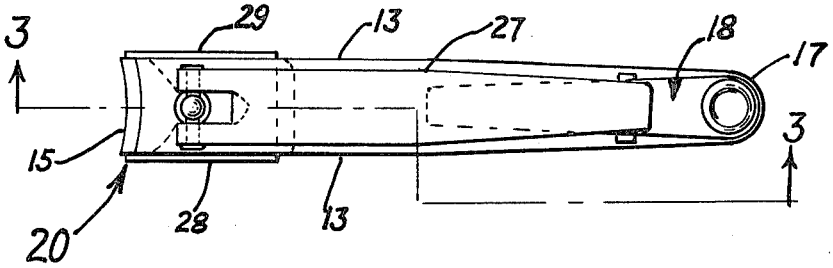
FIG. 2 is a top view of the first embodiment showing section line 3—3.

Referring to the drawings, the improved finger-toe nail clipper having shifting receptacle characterizing the present invention comprises a pair of hardened resilient elongated steel strip upper and lower members or arms 11 and 12 having respectively forward and rearward end portions, which are respectively connected with each other by remarkably inclined portions 11' and 12', and opposite longitudinal sides 13, 13 and 14, 14 in upper and lower forward end portions thereof, said forward end portions being slightly divergent and spaced-apart, face-to-face for movement toward and away from each other, the forward terminal ends of upper and lower strip members 11 and 12 have downturned and upturned mating cutting edges 15 and 16, respectively, opposing each other and extending transversely, thus forming in curved or straight cutting edges for neat trimming and shaping cut of nail portions therebetween as best seen in FIG. 2, while said rearward end portions being rigidly joined together by suitable means, such as spot-welding, hinging, brazing or riveting, etc., to allow said divergent forward end portions of said strip members 11 and 12 a springy movement toward and away from each other while preparing thereon an eyelet joint 17 with a desired attachment 18, whereby a desirably defined space 19 being obtained between said divergent portions of the strip members 11 and 12 to receive receptacles 20, 20A, 20B, 20C, 20D therebetween being shifting longitudinally for selective engagements of said receptacles for retaining and discharging cut-off nail portions 21.

An upstanding post 22 having a reduced portion in diameter as measured in transverse direction of the strip members 11 and 12 adjacent the upper end thereof and a round head 23 at it's lower end, said reduced portion in diameter provided with cut-off means of opposing cut-off portions 24, 24 having respectively a downwardly smoothly inclined surface for smooth slip abutting engagement with the marginal edges of the opening recess 32 described hereinafter when the cutting edges 15, 16 are in cutting engagement with each other, while forming a ellipse-section of said reduced portion in diameter of the post 22 as can be seen from FIGS. 5, 6, 7, said post 22 is disposed in slip-fit and being in journal in vertically aligned two bores 25, 26 with said round head 23 thereof bearing against the opposing outside surface portion of said lower strip member 12, said bores 25, 26 are opened respectively through said forward end portions of the strip members 11, 12 right behind said cutting edges 15, 16 and respectively intermediate said opposite longitudinal sides 13, 13 and 14, 14 thereof, said reduced portion in diameter of said post 22 may not be provided for the constructures of said receptacles 20B, 20C, 20D.

An operating lever 27 having a downwardly projected portion 27', which is provided adjacent the pivoted or hinged end portion of said operating lever 27 to define a fulcrum point with the forward end portion of the upper strip member 11 for its operating engagement, the operating lever 27 is supported by a interconnecting means of hinging or pivoting from the upper end of said post 22 and being swingable into and out of position operative to force and release said divergent forward end portions of the strip members 11 and 12 toward and away from each other, thus actuating said cutting edges 15 and 16 into cutting engagement with each other.

The receptacles 20, 20A, 20B, 20C, 20D are longitudinally shiftingly mounted or received in said defined space 19 therebetween for selective engagements of said receptacles to receive and discharge clip-off nail portions 21, said receptacles 20, 20A, 20B, 20C, 20D are respectively comprised of wall means basically combined with opposite longitudinal side walls 28, 29 and corresponding one of rear wall structures 30, 30', 30'', 30'''.

Said rear wall structures 30, 30', 30'', 30''', are all laterally upwardly disposed between rearward portion of said opposite longitudinal side walls 28, 29 to close the rearward open side of said all receptacles to form a closing room with the opposite longitudinal side walls 28, 29 in the defined space immediately rearward of said cutting edges 15, 16 to receive the cut-off nail portions 21.

Figure 1:
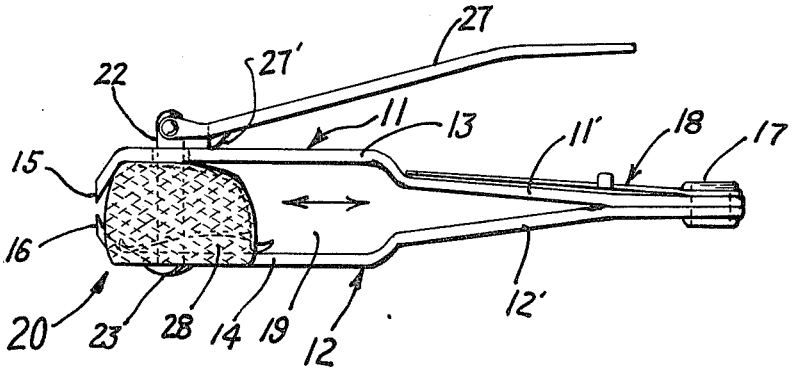
FIG. 1 is a front view of the first embodiment of the invention.
Figure 5:
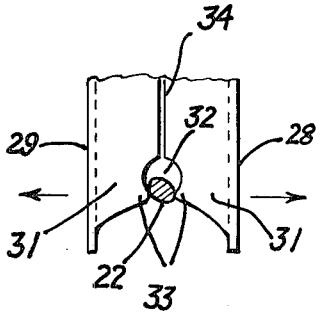
FIG. 5 is a schematic segment figure showing the attitude of occasionally happening squeezing action by the reduced post portion in diameter jammed at the narrowed entrance portion of the opening recess, causing the cleavage displacement motion to opposing longitudinal side walls of the first and second receptacles into the directions as arrows-marked for the first and second embodiments of the invention.
Figure 6:
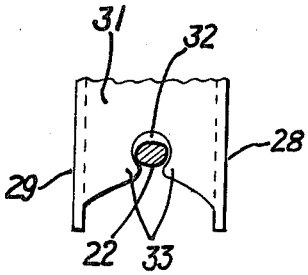
FIG. 6 is a schematic segment figure showing the attitude of the first and second receptacles being received and locked by the reduced portion in diameter of the post.
Figure 9:
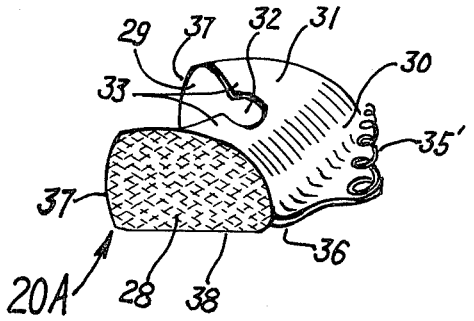
FIG. 9 is a perspective view of the second enlarged modified receptacle.
Figure 8:
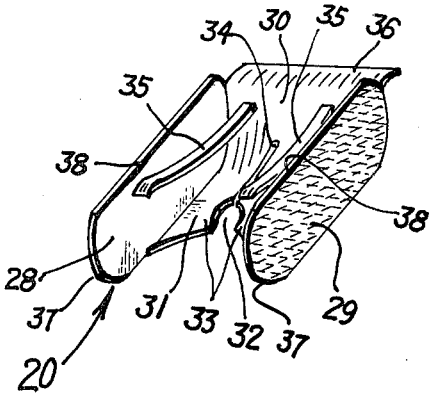
FIG. 8 is a perspective view of the first enlarged receptacle showing the hollowed inside thereof.
Figure 10:
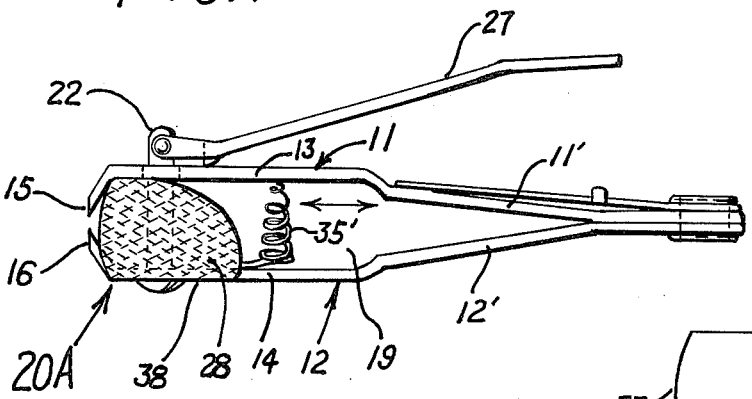
FIG. 10 is a front view of the nail clipper including the second modified receptacle of FIG. 9.

The rear wall structure 30 is secured relative to the rear marginal edges of said opposite longitudinal side walls 28, 29, thus forming a room having its opposite longitudinal and rearward closed walls, said secured rear wall structure 30 includes an upper abutting member 31 defined with forwardly extended wall portion from the upper marginal portion thereof, in which a centrally forwardly opening recess 32 is formed to receive said post 22 for forward positioning of the receptacle 20, 20A (FIGS. 8, 9), said opening recess 32 has a narrowed entrance portion in transverse width formed with a pair of opposite projected wall portions 33, 33 as shown in FIGS. 8, 9 to pass therethrough only said reduced portion in diameter of said post 22 and to receive it therein as can be known from FIGS. 5, 6.

An rearwardly elongated slit opening 34 shown in FIG. 8, which is continuous with said opening recess 32, is centrally included in said rear wall 30 to permit a springy engagement thereof as arrows-marked in FIG. 5 to save the receptacle 20 from undesirable squeezing actions occasionally happening in said narrowed entrance portion by said reduced portion in diameter of post 22 as seen in FIG. 5, said slit opening 34 can be eliminated as in receptacle 20A (FIG. 9) when said transverse width of the narrowed entrance portion is designed slightly less than the length of major axis of ellipse-section of said reduced portion in diameter of the post 22 so as to cover the undesirable jamming action thereof by the springy engagement of said opening recess 32 itself.

Figure 3:
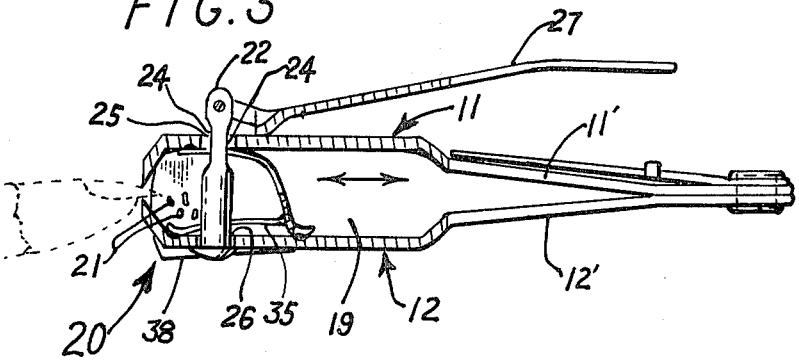
FIG. 3 is a front view of the first embodiment partially in section taken along line 3—3 in FIG. 2, and viewed in the direction indicated by the arrows, showing accumulated severed nail portions and finger nail inserted between respective inturned mating cutting edges.

A pair of leaf spring members 35, 35 (FIG. 8) having free ends being forwardly disposed in symmetrical relationship to the longitudinal center line of the strip members 11 and 12, and being abutted against the upper surface portion of the forward end portion of the lower strip member 12, and the other ends being secured to the inside lower portion of the rear wall 30 in the receptacle 20, the lower marginal portion 36 of the rear wall 30 is abutted against the upper surface portion of the lower strip member 12 as best seen from FIG. 3 to define a fulcrum point therewith, wherein the engaging point of said upper abutting member 31 with the under surface portion of the upper strip member 11 falls in longitudinal distance between the abutting point of said a pair of leaf spring members 35, 35 and the fulcrum point of the lower marginal portion 36 respectively against the opposing upper surface portions of the lower strip member 12 as easily appreciable from the black-marked points in FIG. 3.

Referring to FIG. 9, 10 for the receptacle 20A, a coil spring member 35' having an upper free end being abutted against the under surface portion of the forward end portion of the upper strip member 11, and a lower end mounted and being secured on the rearwardly extented wall portion from the central lower marginal portion 36 of the rear wall 30 thereof.

Whereby the engagements of spring members 35, 35 as well as 35' and said fulcrum point therewith of the lower marginal portion 36 of the rear wall 30 serve respectively to bias the receptacles 20, 20A about said fulcrum point therewith to maintain the upper abutting member 31 being always abutted against the under surface portion of the upper strip member 11 to provide a closing room adaptable to the varying defined space 19 therebetween immediately rearward the cutting edges 15, 16 in its cutting engagement with each other to receive the clip-off nail portions 21.

Figure 11:
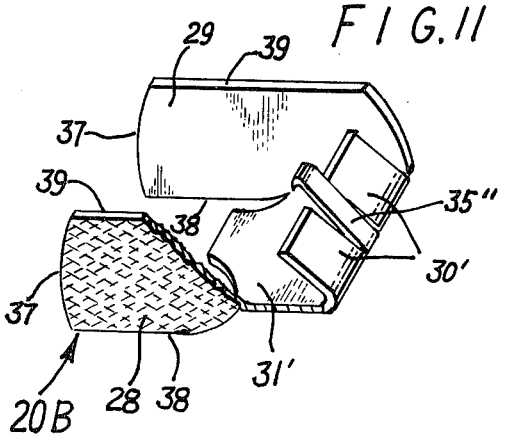
FIG. 11 is a perspective view of the third enlarged receptacle partially in section.

In receptacles 20B, 20C (FIGS. 11, 14), a lower abutting member 31' having a forward extented portion therefrom is flatly disposed between and secured relative to the rearward lower marginal edges of said opposite longitudinal side walls 28, 28, a rear wall structure 30' in receptacle 20B, which is forwardly upstanded and includes intermediately therein an inclined leaf spring member 35'' having a upper free end being abutted against the under surface of the upper strip member 11, thus keeping the lower abutting member 31'' abutted against the upper surface of said lower strip member 12, the other lower end portion thereof as well as the lower marginal portion of said upwardly inclined rear wall 30' are secured together to the rearward marginal edge of said lower abutting member 31', thereby forming a room having opposite longitudinal and rearward closed walls and allowing a springy movement to said inclined leaf spring member 35'' and the rear wall 30', which is adapted to cover the undesirable jamming action thereof rearmost between said inclined portions 11' and 12' of the strip members 11, 12.

Figure 12:
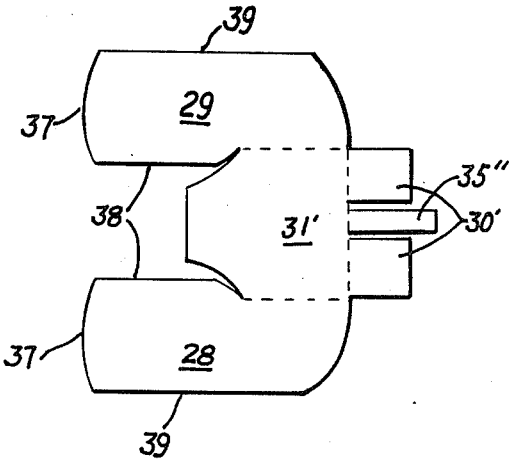
FIG. 12 is a development figure of the third modified receptacle showing dot-lines for bending positions to form the third enlarged modified receptacle of FIG. 11.

Said receptacle 20B can be easily obtained through bending operations along the dot-lines indicated in the development figure of FIG. 12.

Figure 14:
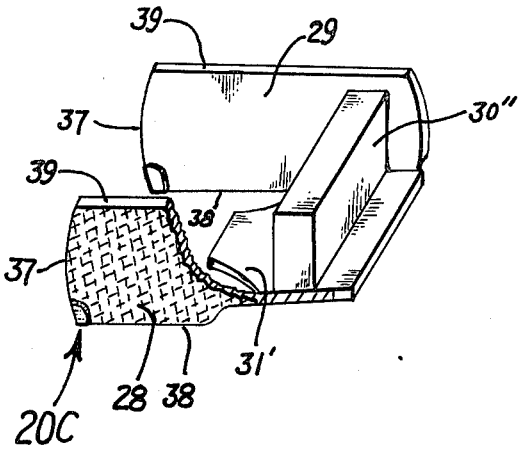
FIG. 14 is a perspective view of the fourth enlarged modified receptacle partially in section.
Figure 15:
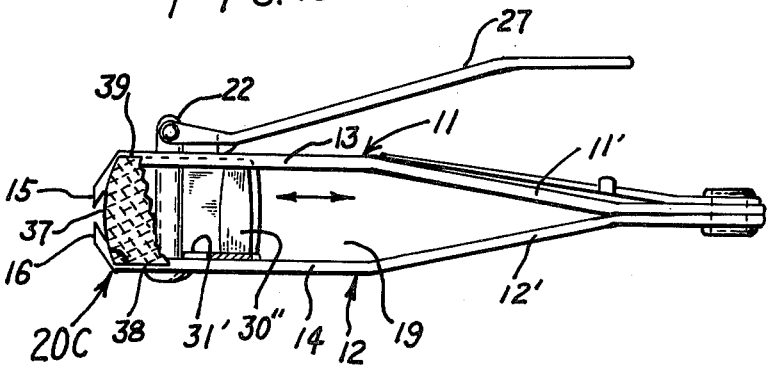
FIG. 15 is a front view of the nail clipper including the fourth modified receptacle partially opened.

The rear wall structure 30'' in receptacle 20C is made of tough resilient rubber material or the like and shaped preferably in hexahedron or a blocklike, which is mounted and secured its bottom surface to the rear portion of said lower abutting member 31' to be upwardly laterally disposed therebetween and closed the rear open side of the receptacle 20C as best seen in FIG. 14, the upper free end surface of the rear wall structure 30'' is abutted against the under surface portion of the upper strip member 11, thus keeping the lower abutting member 31' abutted against the upper surface portion of said forward end portion of the lower strip member 12 as in FIG. 15.

Figure 16:
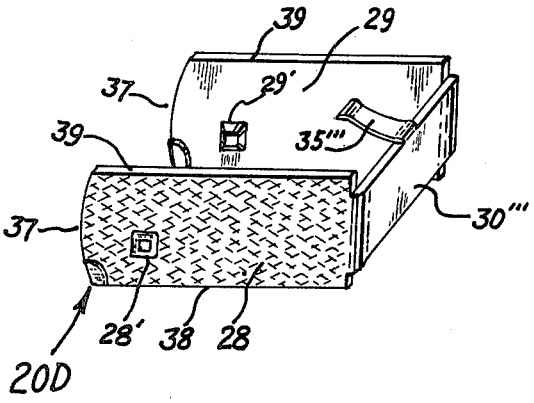
FIG. 16 is a perspective view of the fifth enlarged modified receptacle.
Figure 18:
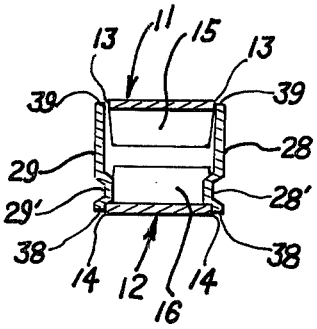
FIG. 18 is a sectional view taken generally along the line 18—18 in FIG. 17.

In the receptacle 20D in FIG. 16, the rear wall structure 30''' is upwardly, laterally disposed between and anchored relative to the rear marginal edges of opposite longitudinal side walls 28, 29, a forwardly and slight upwardly stretched abutting leaf spring member 35''' having a free end and the other end secured to the central upper marginal edge portion of said rear wall 30''', an opposite inwardly projected wall portions 28', 29' are respectively situated in forward-downward portions of said longitudinal side walls 28, 29, which are respectively mounted on opposite upper marginal surface portions of the lower strip member 12, and guided thereon to shift the receptacle 20 longitudinally as appreciable from FIG. 18.

Figure 17:
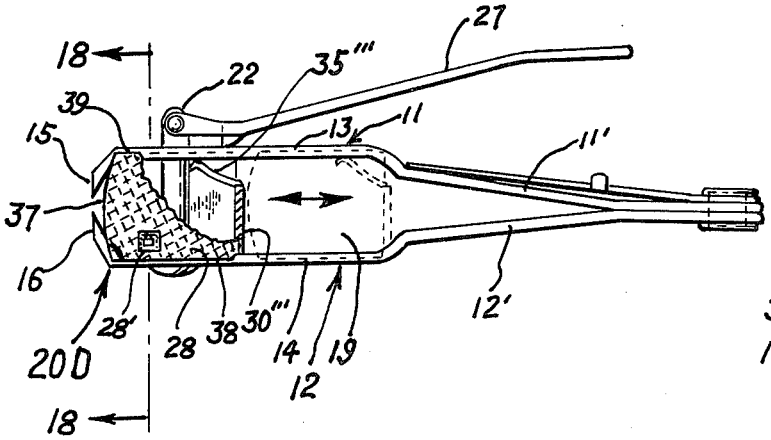
FIG. 17 is a front view of the nail clipper including the fifth modified receptacle partially opened and showing section line 18—18, and the discharging position of said receptacle in dot-lines.

The free end of said abutting leaf spring member 35''' thereof is abutted against the under surface portion of said forward end portion of the upper strip member 11, thus keeping the lower marginal portion of the rear wall 30''' and said opposite inwardly projected wall portions 27', 28' beared on the opposing upper surface portions of the forward end portion of the lower strip member 12 as seen in FIG. 17, 18, to maintain a closing room to receive the clip-off nail portions 21 in the varying defined space 19 therebetween when the cutting edges 15, 16 are in cutting engagement with each other.

Figure 13:
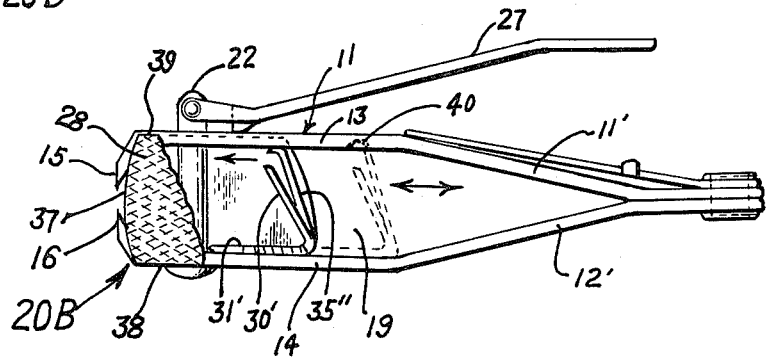
FIG. 13 is a front view of the nail clipper including the third modified partially opened receptacle showing the discharging position of the third receptacle in dot-lines.

The heights of the rear wall structure 30' and 30''' in receptacles 20B and 20D are adapted to be slightly less than that of a minimum defined space 19 therebetween when the cutting edges 15, 16 are in its cutting abuttment against each other to assure a free cutting motion of the cutting edges 15, 16 as can be known from FIGS. 13, 17.

Wherein the opposite longitudinal walls 28, 29 have respectively knurled outside surfaces (as marked in inclined dot-lines crossed each other) for non-slip operation, an opposite forward curved marginal edges 37, 37 to define closure walls for the opposing longitudinal side openings right behind the cutting edges 15, 16, and downwardly and upwardly extended opposite wall portions 38, 38 and 39, 39 for longitudinal guide and closure walls of the receptacles 20, 20A, 20B, 20C, 20D.

Said opposite downwardly and upwardly extended wall portions 38, 38 and 39, 39 are respectively slidingly overlaid the opposite longitudinal sides 14, 14 and 13, 13 thereof and guided thereon along the longitudinal sides 14, 14 and 13, 13 thereof to shift the receptacles longitudinally, thus producing a convenient way of selective engagements thereof relative thereto between receiving and discharging engagements, forward and rearward positions respectively.

Figure 7:
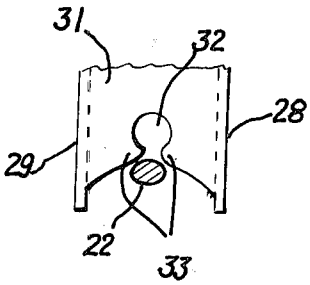
FIG. 7 is a schematic segment figure illustrating the attitude of the first and second receptacles in its rearward position with the forward marginal edges of the narrowed entrance portion of the forwardly opening recess abutted against the opposing behind surface portion of the reduced portion in diameter of the post.
Figure 4:
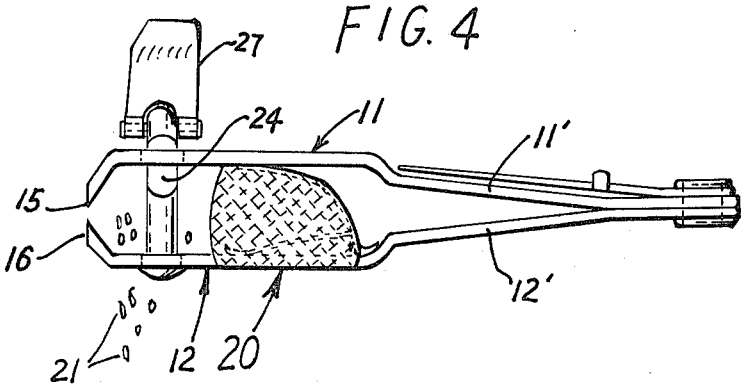
FIG. 4 is a front view of the first embodiment with the first receptacle staying in the discharging engagement position, and with the operating lever in the transverse position of substantially at right angle to the longitudinal center line of the strip members, and the attitude of discharging the deposited severed nail portions.

In operations of the first and second embodiments respectively including the first and second receptacles 20 and 20A, the operating lever 27 should turn in either direction to substantially right angle position to the longitudinal center line thereof and should turn back to its longitudinal position, the former operation is to have said opening recess 32 of the receptacles 20, 20A receive in and also release from the reduced portion in diameter of the post 22, as can be seen from FIGS. 4, 5 and the latter operation is to have the reduced portion in diameter of the post 22 received and locked therein for the forward position or receiving engagement of the receptacles 20, 20A, and as well rearward or discharging or non-active position thereof as can be seen from FIGS. 6, 7.

In third embodiment of the invention in FIG. 13, a forwardly advancing component force as arrow-marked is produced from the abutting engagement of said free end of the upwardly inclined leaf spring member 35'' against the under surface portion of slightly divergent (slightly inclined from forward to rearward) forward end portion of upper strip member 11, upon cutting motions of the cutting edges 15, 16, said advancing component force keeps the front marginal edge of the forward extend portion of the lower abutting member 31' abutted against the rear lower opposing portion of the post 22, thus enabling the receptacle 20B to be stayed in forward position for receiving engagement thereof, and with the free end of said inclined leaf spring member 35'' seated in the recess 40, which is downwardly opened in the rearward under surface portion of the forward end portion of the upper strip member 11, the discharging engagement and non-active positioning of the receptacle 20B can be done.

Figure 19:
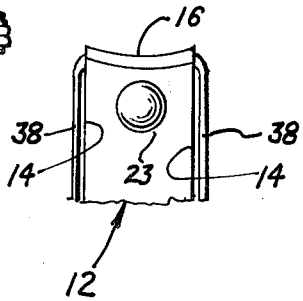
FIG. 19 is a bottom plan segment view showing the relatively tightly fitted guide wall portions for the opposite longitudinal sides of the lower strip member in the fourth and fifth embodiments of the invention to provide a selective self-positioning means of the fourth and fifth receptacles respectively.

In the fourth and fifth embodiments of the invention in FIGS. 15, 17, the opposing forward-downward corner portions of the longitudinal side walls 28, 29 of the receptacles 20C, 20D have respectively inwardly projected wall portions being relatively tightly fitted for the opposite longitudinal sides 14, 14 of the lower strip member 12, as seen in FIG. 19 for the selective positioning means therefrom, the requirement of forward position or receiving engagement of the receptacles 20C, 20D can be respectively met with the disposing actions of the forward marginal edges of the forward extended portion of the lower abutting member 31' in the receptacle 20C and said abutting leaf spring member 35''' respectively being abutted against the rear opposing portion of the post 22 as seen in FIGS. 15, 17, and for rearward or discharging or non-active positions, with just disposing the receptacles 20C, 20D in rearward position overcoming the resistance from said fitted portions.

The requirements of turning operations of the operating lever 27 in third, fourth, fifth embodiments of the invention are not considered for forward and reward positioning operation of the receptacles 20B, 20C, 20D.

The opposite inclined portions 11' and 12' in upper and lower strip member 11 and 12 in first, second, fifth embodiments of the invention respectively include stepped portions to have a reduced portion with such a rapid manner in height of the defined space 19 therebetween to avoid the undesirable jamming action rearmost therebetween by offering a definite action of limiting the longitudinal displacement to rearward direction for the receptacles 20, 20A, 20D as can be appreciable from FIG. 4.

The finger-toe nail clippers combined with the receptacles 20, 20A, 20B, 20C, 20D may be enjoyed the cutting of such a conventional manner with said receptacles being kept in said rearward or discharge or non-active position as in times needed.

The foregoing is considered as illustrative only of the principles of the invention.

Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed is follows:

1. A finger-toe nail clipper having shifting receptacle, comprising a pair of substantially horizontally disposed upper and lower elongated spring material strip members including forward and rearward end portions, which are respectively connected with each other by remarkably inclined opposing portions of said strip members, and opposite longitudinal sides in each forward end portion thereof, said rearward end portions being rigidly joined together by suitable means and said forward end portions being slightly divergent and spaced apart for movement toward and away from each other, the forward terminal ends of said upper and lower strip members including downturned and upturned mating cutting edges, respectively, opposing each other and extending transversely of said forward end portions, thus forming in curved edges for neat trimming cut of nail portions therebetween, whereby a desirably defined space obtained between said divergent forward end portions of the strip members to receive a receptacle being shifting longitudinally for selective engagement of said receptacle to receive and discharge the cut-off nail portions, an upstanding post having a round head at its lower end disposed in slip-fit and being in journal in the vertically aligned two bores with said round head thereof beared against the opposing outside surface portion of the lower strip member, said two bores being opened respectively through the forward end portions of said strip members, an operating lever pivotally supported from the upper end of said post and being engageable with said upper strip member and swingable into and out of position operative to force said forward end portions of said strip members toward each other, thus bring said cutting edges into cutting engagement with each other, a longitudinally shifting receptacle for receiving and discharging the cut-off nail portions, said receptacle being comprised of opposite longitudinal side walls of said receptacle, and a rear wall structure upwardly disposed between and being secured relative to the rear marginal edges of said opposite longitudinal side walls, said rear wall structure including an upper abutting member defined with forwardly extended wall portion from the upper marginal portion of said secured rear wall structure, and lower marginal edges of said side walls projecting downwardly, respectively, over said opposite longitudinal sides of said lower strip member, whereby forming a downwardly and forwardly opened body portion of said receptacle received and being shiftingable longitudinally forth and back between forward end portions of said strip members, immediately rearward of said cutting edges with said upper abutting member engaging with the underside of said upper strip member, the forward portion of said upper abutting member including a central forwardly opening recess formed therein in which the opposing portion of said post being received, the lower marginal portion of said rear wall being abutted against the opposing upper surface portion of said lower strip member, a spring means combined with said body portion of said receptacle being associated with one of said strip members except a rearwardly and upwardly inclined resilient leaf spring member being included centrally in the lower marginal portion of said rear wall structure, and whose upper rear end is abutted against the undersurface of said upper strip member centrally intermediate its opposite ends, the engagement of said lower marginal portion of said rear wall structure with the lower strip member defining a fulcrum point of engagement of said receptacle with said lower strip member, and the engagement of said spring means with one of said strip members resulting in serving to bias said receptacle about said fulcrum point to maintain said upper abutting member abutted against the underside of the forward end portion of said upper strip member.

2. A finger-toe nail clipper having shifting receptacle as defined in claim 1, wherein said spring means includes a pair of leaf spring members having free ends thereof being forwardly disposed in symmetrical relationship to the longitudinal center line of said strip members and the other ends being secured, respectively, to the inside lower portions of said rear wall structure, the engagements of said free ends thereof abutted against the upper surface portions of said forward end portion of said lower strip member, and of said fulcrum point defined with the lower marginal portion of said rear wall structure and the upper surface portion of said lower strip member serve to bias said receptacle about said fulcrum point to maintain said upper abutting member being abutted against the under surface portion of the forward end portion of said upper strip member, the abutting point of said upper abutting member against said under surface portion thereof should falls within the longitudinal distance between the engaging points of said free ends with said upper surface portions of said lower strip member and said fulcrum point defined with lower marginal portion of said rear wall structure abutted against the upper surface portion of said lower strip member. (For FIG. 8)

3. A finger-toe nail clipper having shifting receptacle as defined in claim 1, wherein said spring means also includes a coil spring member having an upper free end being abutted against the under surface portion of the forward end portion of said upper strip member, and a lower end thereof mounted and being secured on the rearwardly extented seat wall portion from the central lower marginal portion of said rear wall structure, the engagements of said coil spring member and said fulcrum point thereof also serve to bias said receptacle about said fulcrum point thereof to maintain said upper abutting member being always abutted against the under surface portion of said upper strip member. (For FIG. 9)

4. A finger-toe nail clipper having shifting receptacle as defined in claim 1, wherein said receptacle including the combination of said body portion and said spring means, said body portion comprised of opposite longitudinal side walls of said receptacle, and a rear wall structure upwardly disposed between and being secured relative to the rear marginal edges of said opposite longitudinal side walls thereof, an upper abutting member being defined with forwardly extended wall portion from the upper marginal portion of said secured rear wall structure, a central forwardly opened recess being formed therein forward portion of said upper abutting member, in which the opposing portion of said post received, lower marginal edges of said side walls projecting, respectively, downwardly over the opposite longitunial sides of said lower strip member, whereby forming a downwardly and forwardly opened body portion of said receptacle received and being shiftingable longitudinally forth and back between forward end portions of said strip members.

5. A finger-toe nail clipper having shifting receptacle as defined in claim 1, wherein said centrally forwardly opening recess includes a narrowed entrance portion in transverse width defined with an opposing inwardly projected wall portions being included therein said upper abutting member, an reduced portion in diameter of said post having an ellipse-section whose major diameter is slightly bigger and whose minor diameter is slightly less than said narrowed entrance portion, respectively, and an elongated slit opening being continuous with said opening recess permits to widen easier said narrowed entrance portion to pass through said major diameter portion of said reduced portion of said upstanding post.

6. A finger-toe nail clipper having shifting receptacle as defined in claim 1, wherein said receptacle is slidably received between said strip members for longitudinal shifting relative thereto between forward and rearward active and inactive positions, respectively.

7. A finger-toe nail clipper having shifting receptacle as defined in claim 1, wherein said receptacle enables one to enjoy such a conventional using manner of said nail clipper with keeping the receptacle being in inactive rearward position thereof.

8. A finger-toe nail clipper having shifting receptacle as defined in claim 1, wherein said opposing remarkably inclined portions of said strip members include an opposite stepped portions to provide a reduced portion of such a rapid manner in vertical distance of said defined space rearward therebetween.

9. A structure as defined in claim 5, wherein said elongated slit opening can be eliminated when said opening recess having narrowed entrance portion in transverse width and said reduced portion in diameter of said upstand post are designed to be smoothly accommodated with each other to avoid said undesirable jamming action with each other during the disposing operations of said receptacle.

10. A finger-toe nail clipper having shifting receptacle as defined in claim 1, wherein said opposing downwardly projected wall portions from the lower marginal edges of said opposite longitudinal side walls to be slidingly overlaid said opposite longitudinal sides of the lower strip member to be guided thereon along said opposite longitudinal sides, consequently resulting in the receptacle shifting longitudinally to provide a convenient way of selective engagements thereof relative thereto between forward and rearward, active and inactive positions, respectively.

* * * * *